US007597451B2

(12) United States Patent
Chikazawa et al.

(10) Patent No.: US 7,597,451 B2
(45) Date of Patent: Oct. 6, 2009

(54) BACKLIGHT UNIT AND LIQUID CRYSTAL DISPLAY DEVICE

(75) Inventors: Hideyuki Chikazawa, Tsu (JP); Mitsuhiro Moriyasu, Suzuka (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 175 days.

(21) Appl. No.: 11/515,007

(22) Filed: Sep. 5, 2006

(65) Prior Publication Data

US 2007/0058358 A1 Mar. 15, 2007

(30) Foreign Application Priority Data

Sep. 6, 2005 (JP) ..... 2005-257718

(51) Int. Cl.
*F21S 10/00* (2006.01)

(52) U.S. Cl. ..... 362/231; 362/612; 362/614

(58) Field of Classification Search ..... 362/231, 362/612, 613, 614; 349/70, 68; 345/102
See application file for complete search history.

(56) References Cited

U.S. PATENT DOCUMENTS

| | | | | |
|---|---|---|---|---|
| 3,346,689 | A | 10/1967 | Parstorfer | |
| 5,521,797 | A * | 5/1996 | Kashima et al. | 362/617 |
| 2005/0099791 | A1* | 5/2005 | Nagel | 362/31 |
| 2005/0140636 | A1 | 6/2005 | Chung et al. | |
| 2006/0002143 | A1* | 1/2006 | Gu et al. | 362/612 |
| 2006/0023447 | A1* | 2/2006 | Justel et al. | 362/231 |

FOREIGN PATENT DOCUMENTS

| | | | |
|---|---|---|---|
| JP | 11-202330 | A | 7/1999 |
| JP | 2001-135118 | A | 5/2001 |
| JP | 2002-258281 | A | 9/2002 |
| JP | 2003-140110 | A | 5/2003 |
| JP | 2003-330424 | A | 11/2003 |
| JP | 2004-139876 | A | 5/2004 |
| JP | 2004-139876 | A | 5/2004 |
| JP | 2004-246117 | A | 9/2004 |
| JP | 2005-190991 | A | 7/2005 |
| JP | 2005-210028 | A | 8/2005 |
| WO | WO-01/11421 | A1 | 2/2001 |

* cited by examiner

*Primary Examiner*—Stephen F. Husar
*Assistant Examiner*—Peggy A. Neils
(74) *Attorney, Agent, or Firm*—Birch, Stewart, Kolasch & Birch, LLP

(57) ABSTRACT

To provide a backlight unit capable of improving color purity of a prescribed emission color as well as obtaining a uniform emission colors in the entire device, and a liquid crystal display device comprising thereof. Backlight unit B comprises: a LED 13 for compensating emission intensity of red wavelength light of a fluorescent tube 11, being arranged in between each of a plurality of said fluorescent tubes 11 arrayed in up and down directions, and a LED 13*a* for compensating emission intensity of red wavelength light of a fluorescent tube 11*a*, being arranged in the outside of each of two fluorescent tubes 11*a* arranged in the outermost of a plurality of said fluorescent tubes 11.

21 Claims, 7 Drawing Sheets

(a)

(b)

(a)

(b)

(a)

(b)

BACKLIGHT UNIT AND LIQUID CRYSTAL DISPLAY DEVICE

BACKGROUND OF THE INVENTION

1. Field of the Invention

The present invention relates to a backlight unit for, for example, liquid crystal display (LCD) devices as typified by a liquid crystal television, and more particularly, to a technology for improving color purity of emission colors of a backlight unit.

2. Description of the Related Art

Generally, fluorescent tubes using R (red), G (green), and B (black) as primary colors are used for a backlight unit for LCD devices as typified by a liquid crystal television. Such fluorescent tubes have a feature that the emission intensity of red wavelength light is lower in comparison with those of green and blue, and therefore, the color purity of emission colors of backlight unit is not sufficient, thereby causing a problem of affecting the color reproducibility of a display image in a LCD device. In particular, pure red is hard to be displayed in a LCD device.

Here, in a patent literature 1 (Unexamined Japanese Patent Publication No. 2004-139876), a LCD device intended to improve the color reproducibility of a display image by using two kinds of light sources: a fluorescent tube and a LED (light emitting diode), in a backlight unit is disclosed. A LCD device C configured as described above is illustrated in FIG. 7 (quoted from FIG. 7 in Patent literature 1). FIG. 7(*a*) shows an elevation view of a conventional LCD device C, and FIG. 7(*b*) shows a sectional side view of a conventional LCD device C.

As illustrated in FIG. 7, LCD device C comprises: a plurality of fluorescent tubes 31 arrayed in up and down directions, a LED 32 for emitting a red wavelength light arrayed in between each of Fluorescent tubes 31, an inverter circuit 33 for controlling a drive of Fluorescent tube 31, a LED lighting circuit 34 for controlling a light emission of LED 32, a dimming control means 35 for adjusting the emission intensity of Fluorescent tube 31 and LED 32, a power supply circuit 36, a reflection sheet 37A as a optical member of every kind, a diffusion plate 37C, a diffusion sheet 37D, a prism sheet 37E, a reflection polarizing sheet 37F, a chassis 38 for housing those aforementioned, and a LCD panel 39 for displaying an image.

In LCD device C configured as mentioned above, improvement of color reproducibility of a display image is provided since the emission intensity of R (red) wavelength light by Fluorescent tube 31 is compensated by the light emission of red wavelength light by LED 32 arrayed in between each of Fluorescent tubes 31, thereby improving color purity.

However, in LCD device C, the emission intensity of red wavelength light of Fluorescent tube 31 in the outside of Fluorescent tubes 31 arrayed in upper and lower ends of LCD device C cannot be compensated since LED 32 is arrayed only in between each of Fluorescent tubes 31. Therefore, in LCD device C, the emission colors of a backlight are different between near the upper and lower ends and near the center, and thus causing a problem of color shading generated in a display image in LCD device C.

Consequently, this invention has been invented considering the foregoing conditions, and the purpose of this invention is to provide a backlight unit capable of improving color purity of a prescribed emission color as well as obtaining an uniform emission colors in the entire device, and a LCD device comprising thereof.

SUMMARY OF THE INVENTION

In order to achieve the above purpose, this invention is to be applied to a backlight unit comprising a first compensating light source for compensating emission intensity of a prescribed wavelength light of a fluorescent tube, being arranged in between each of a plurality of said fluorescent tubes arrayed in a prescribed direction, wherein said backlight unit further comprises a second compensating light source for compensating emission intensity of a prescribed wavelength light of the fluorescent tube, being arranged in the outside of each of two fluorescent tubes arranged in the outermost of said plurality of fluorescent tubes.

According to a backlight unit of this invention which is constituted as mentioned above, not only compensation of emission intensity of a prescribed wavelength light of the fluorescent tube in between the fluorescent tubes, but also compensation of emission intensity of a prescribed wavelength light of the fluorescent tube in the outside of two fluorescent tubes arranged in the outermost can be realized, and therefore, color purity of the prescribed emission color can be improved, and at the same time, an uniform emission colors in the entire backlight unit can be obtained.

Consequently, with a LCD device comprising a backlight unit configured as above, color reproducibility of a display image is increased, thereby preventing color shading.

Here, the first compensating light source arranged in between each of the fluorescent tubes is for compensating emission intensity of the prescribed wavelength light of the two fluorescent tubes in its both sides. However, the second compensating light source arranged near vertical ends of the backlight unit is for compensating emission intensity of only one fluorescent tube, and thus the emission intensity of the prescribed wavelength light of said fluorescent tube is so compensated beyond necessity that the emission colors of the backlight unit may become nonuniform. In addition, it is still concerned that when the prescribed wavelength light emitted from the second compensating light source is reflected upon other structural elements arranged in upper or lower directions of the second compensating light source or upon the chassis of the backlight unit, the emission intensity in the outside of the fluorescent tube arranged in the outermost may be compensated beyond necessity.

Thus, the emission intensity of the second compensating light source is preferably lower than that of the first compensating light source. In particular, the emission intensity of the second compensating light source may be nearly half of that of the first compensating light source.

This enables enhancement of the uniformity in emission colors of the entire backlight unit, thereby more assuredly preventing color shading of a display image in a LCD device comprising the present backlight unit.

Here, the first and second compensating light sources may be realized by, for example, a plurality of light-emitting elements arrayed in a longitudinal direction of the fluorescent tubes.

In this case, when each of said light emitting elements includes at least two or more light-emitting elements of which the presence or absence of emission can be controlled separately, the emission intensity can be differed between the first and second compensating light sources by switching the number of light-emitting elements to be emitted. In particular, with emission of two light-emitting elements in the first compensating light source while one in the second compensating light source, the emission intensity of the second compensating light source may be controlled to nearly half of that of the first compensating light source. Also, with such structure, the light-emitting elements employed in the first and second compensating light sources can be standardized, and a great effect in productivity can be expected since not requiring different light-emitting elements.

Additionally, in a large-size backlight unit, a light source substrate, in which the first and second compensating light sources are mounted, may be constituted to include a plurality of segmented substrates segmented in the array direction of the fluorescent tubes, in other words, to form the light source substrate by combining the plurality of segmented substrates.

In this case, provided that L is the number of arrayed fluorescent tubes, X is the number of light-emitting elements to be arrayed in a direction parallel to the array direction of the fluorescent tubes in the segmented substrate, and N is the number of the segmented substrate, a relation: X=(L+1)/N is preferred to be satisfied in the structure of the above. This enables standardization of the structure of the segmented substrates since not requiring segmented substrates of different structures, thereby realizing an efficient productivity.

Also, a backlight unit employing one or a plurality of inverter circuits for driving two of the fluorescent tubes may be constituted so as to satisfy a relation: X=(2M+1)/N when M is the number of inverter circuits. In short, by identifying the number of the fluorescent tubes by means of the number of the inverter circuits, a structure capable of standardizing the structure of the segmented substrates can be realized.

The light-emitting elements are preferably arrayed in a zigzag manner within the segmented substrates, thereby preventing color shading in emission intensity of a prescribed wavelength of the fluorescent tube that is compensated by said light-emitting elements.

When the light-emitting elements are particularly arrayed so as to be arranged, not in the both ends of one diagonal line in the segmented substrate, but in the both ends of the other diagonal line in the segmented substrate, the light-emitting elements can be arranged in a zigzag manner even in a combining site when the segmented substrates are combined. And also in this case, it is needless to say that a great effect in the productivity can be realized by the standardization of the structure of the segmented substrates.

According to this invention, not only compensation of emission intensity of a prescribed wavelength of the fluorescent tube in between each of the fluorescent tubes, but also compensation of emission intensity of a prescribed wavelength of the fluorescent tube in the outside of two fluorescent tubes arranged in the outermost can be realized, thereby improving color purity of the prescribed emission color, and at the same time, obtaining an uniform emission colors in the entire backlight unit.

Consequently, in a LCD device comprising a backlight unit constituted as mentioned above, the color reproducibility in a display image is enhanced, and occurrence of color shading can therefore be prevented.

These and other objects, features and advantages of the present invention will become more apparent upon reading of the following detailed description along with the accompanied drawings.

DETAILED DESCRIPTION OF THE PREFERRED EMBODIMENTS

With embodiments of the present invention described hereinafter with reference to the accompanying drawings, it is to be understood that the invention is not limited to those precise embodiments, and that various changes and modifications may be effected therein by one skilled in the art without departing from the scope or spirit of the invention as defined in the appended claims.

Figure 1:
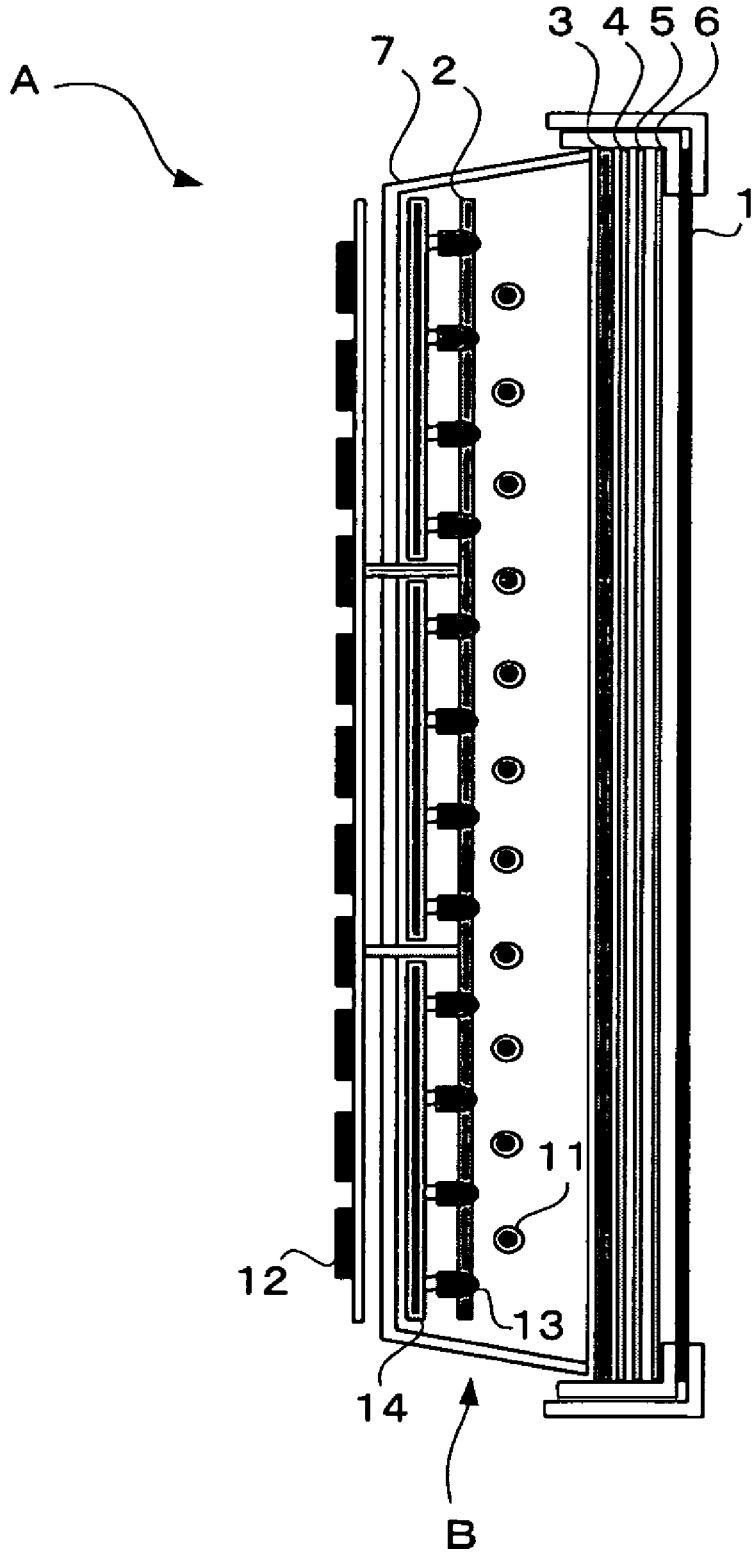
FIG. 1 shows a sectional side view of a LCD device according to an embodiment of the present invention.
Figure 2:
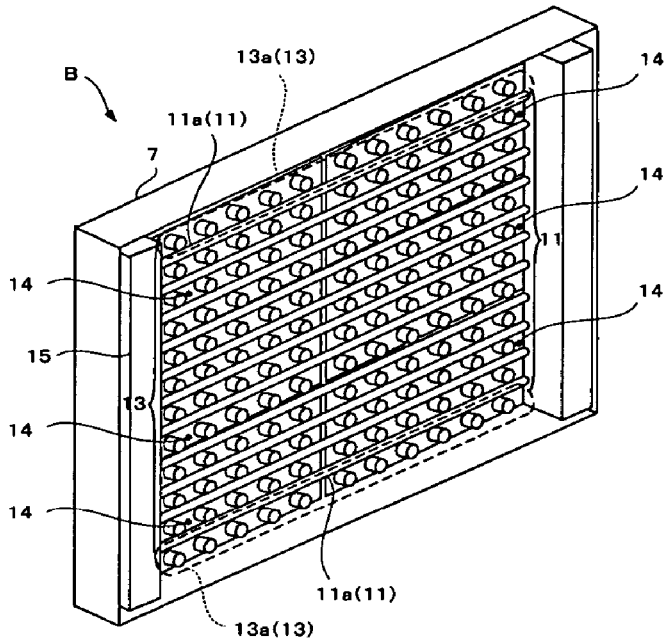
FIG. 2 shows a schematic structure of a backlight unit according to an embodiment of the present invention.
Figure 2:
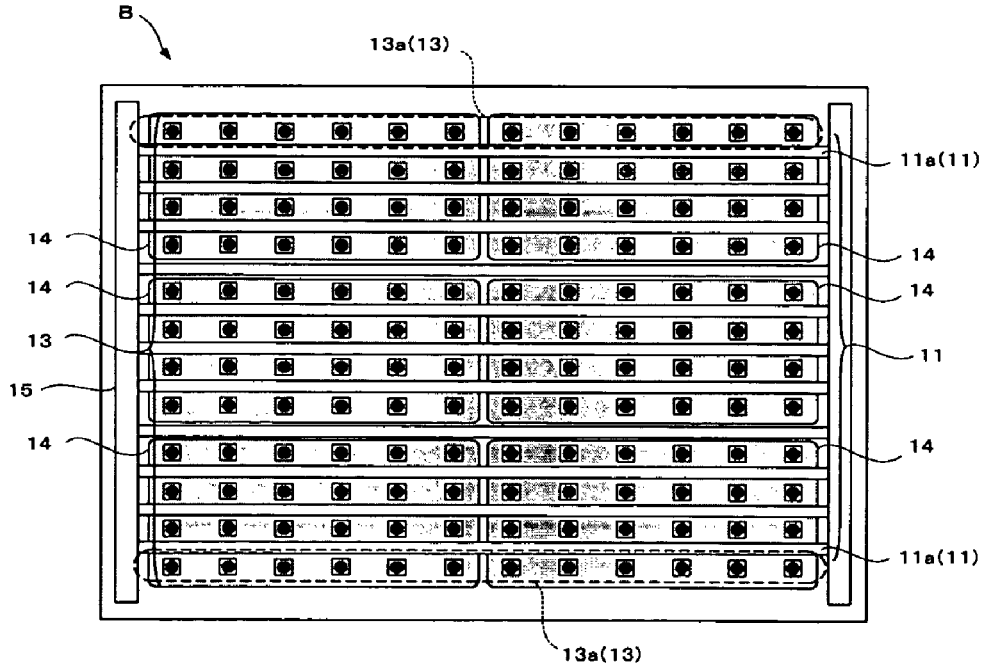

Here, FIG. 1 shows a sectional side view of a LCD device A according to an embodiment of the present invention, and FIG. 2 shows a general structure of a backlight unit B according to an embodiment of the present invention: (a) is a perspective view and (b) is an elevation view.

Firstly, as referring now to FIG. 1, a schematic structure of a LCD device according to an embodiment of the present invention is described.

As illustrated in FIG. 1, LCD device A is schematically constituted by: a LCD panel 1 for displaying an image, a backlight unit B for illuminating LCD panel 1 from behind, a reflection sheet 2 as an optical member for providing the emission of Backlight unit B with color scheme property and luminance distribution property, a diffuser 3, a diffusion sheet 4, a prism sheet 5, a reflection polarizing sheet 6, and a chassis for housing those aforementioned.

Next, as referring to FIGS. 1 and 2, Backlight unit B is described in details.

Backlight unit B is schematically constituted by: a plurality of fluorescent tubes 11 arrayed in up and down directions, a plurality of inverter circuits 12 for controlling the drive of each Fluorescent tube 11, LED (light emitting diode) 13 for compensating emission intensity of red wavelength light of Fluorescent tube 11 by emitting red wavelength light as being multi-arrayed in the longitudinal and array directions of Fluorescent tube 11, a plurality of LED substrates 14 (one example of a segmented substrate) mounting LED 13, a lump holder 15 for supporting Fluorescent tube 11, and a LED control circuit not shown in the figures for controlling light emission of LED 13.

Each of LEDs 13 is an identical part internally comprising two light-emitting elements for emitting red wavelength light at nearly the same emission intensity, and the emission of each of the light-emitting elements is capable of being controlled separately by LED control circuit (not shown).

Additionally, the present embodiment is explained as referring to an example of a technique for enhancing the color purity of red by compensating the emission intensity of red wavelength light of Fluorescent tube 11 by using LED 13, however, it is needless to say that this invention finds application in other colors, for example, blue and green for enhancing color purity.

Here, Backlight unit B is constituted so as to satisfy a relation: X=(L+1)/N with L: the number of arrayed Fluorescent tubes 11, X: the number of LED 13 to be arrayed in a direction parallel to the array direction of Fluorescent tubes 11 in LED substrate 14, and N: the number of LED substrates 14. Concretely, as illustrated in the figure, a relation: X=(L+

1)/N is satisfied provided that X=4, L=11, and N=3 (X, L, and N are integer numbers) in Backlight unit B.

This enables Backlight unit B to employ substrates of an identical shape as a plurality of LED substrates 14, thereby realizing a great productivity without requiring substrates of different shapes. Those numbers of Fluorescent tubes 11, LED 13, and LED substrates 14 in this embodiment are obviously the mere examples, and could be any numbers that may satisfy the relation: X=(L+1)/N for the purpose of employing substrates of an identical shape as a plurality of LED substrates 14.

Figure 7:
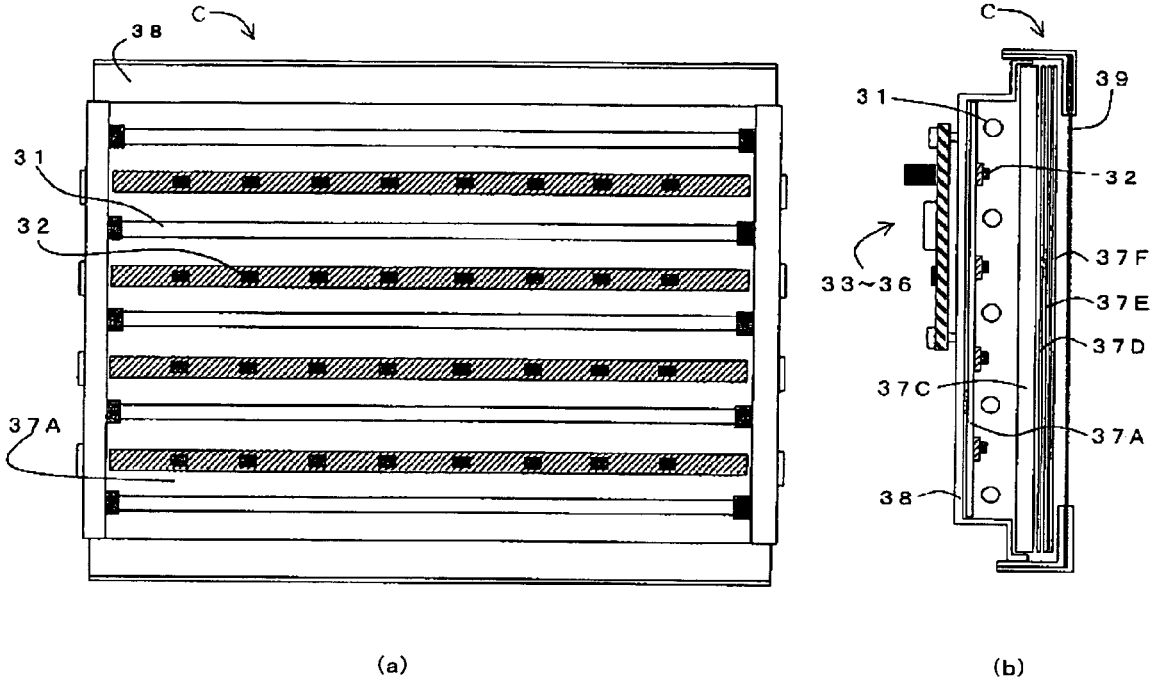
FIG. 7 shows a schematic structure of a conventional LCD device.

As described in the former clause, in a conventional LCD device C (see FIG. 7), color shading has been occurred in a display image since LED 32 was arranged only in between each of Fluorescent tubes 31 without compensation of emission intensity in the outside of Fluorescent tubes 31 arranged in the outermost of Fluorescent tubes 31.

However, in Backlight unit B as illustrated in both FIGS. 1 and 2, LED 13*a* is arranged not only in between each of Fluorescent tubes 11, but also in the outside of each of two Fluorescent tubes 11*a* arranged in the outermost of Fluorescent tubes 11. Here, LED 13 arranged in between each of Fluorescent tubes 11 (hereinafter referred to as "LED 13*b*") is one example of a first compensating light source, and said LED 13*a* is one example of a second compensating light source.

In Backlight unit B constituted as above, LED 13*a* and LED 13*b* are emitted at the same time of emission of Fluorescent tubes 11. Here, when LED 13*b* is designed so as to moderately compensate emission intensity of red wavelength light of two Fluorescent tubes 11 in both sides, the emission intensity of red wavelength light of Fluorescent tube 11*a* might be compensated beyond necessity because of the emission of LED 13*a* that compensates emission intensity of red wavelength light of one Fluorescent tube 11. Therefore, the emission intensity of LED 13*a* is preferred to be lower than that of LED 13*b*.

Thus, in Backlight unit B, LED 13*b* is designed so that two light-emitting elements inside simultaneously emit, and LED 13*a* is designed so that only one of two light-emitting elements inside emit, both are controlled by LED control circuit. This makes the emission intensity of LED 13*a* half of that of LED 13*b*.

As mentioned above, in Backlight unit B, the emission intensity of red wavelength light in between each of Fluorescent tubes 11, as well as the emission intensity of red wavelength light of Fluorescent tube 11*a* in the outside of Fluorescent tube 11*a* are compensated respectively by LED 13*b* and LED 13*a*. This enables improvement of the color purity of red wavelength light in the entire Backlight unit B, thereby obtaining a uniform emission colors in the entire Backlight unit B. Consequently, color shading in a display image in LCD device A comprising Backlight B can be prevented.

Particularly in Backlight unit B, the emission intensity of LED 13*a* is half of that of LED 13*b*, while the emission intensity of red wavelength light in between each of Fluorescent tubes 11 compensated by LED 13*b* as well as the emission intensity of red wavelength light of Fluorescent tube 11*a* in the outside of Fluorescent tube 11*a* compensated by LED 13*a* become uniform, thereby obtaining a high uniformity in emission colors in the entire Backlight unit.

Additionally, in the present embodiment, though a LED is employed as a light source for compensating emission intensity of red wavelength light of Fluorescent tube 11, it is not intended to limit the scope of the present invention, and other light sources may be employed. Also, as a method for lowering the emission intensity of LED 13*a* than that of LED 13*b* arranged in between each of Fluorescent tubes 11, setting a gap between each of applied voltages, as well as employing light-emitting elements of different emission intensity at a same voltage may find application.

Embodiment 1

Figure 3:
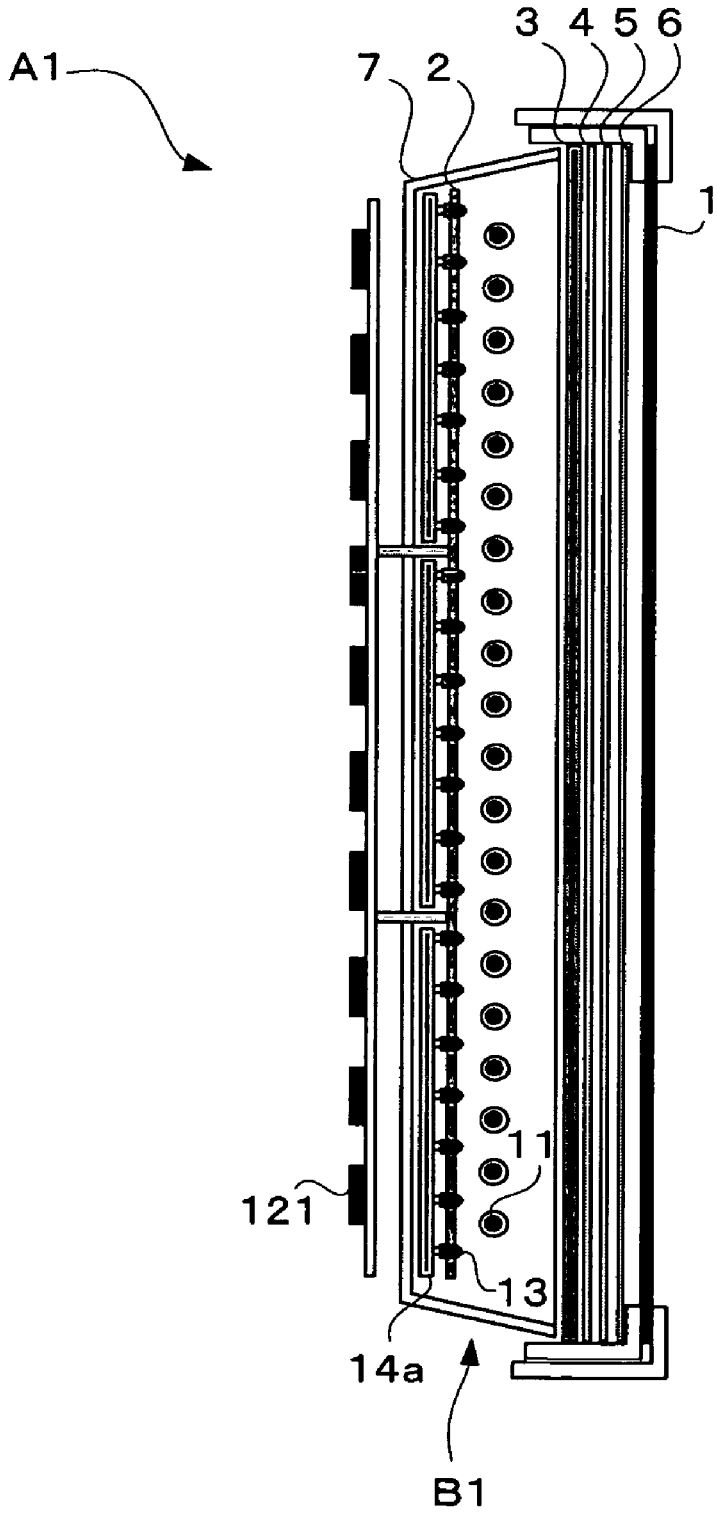
FIG. 3 shows a sectional side view of a LCD device according to Embodiment 1 of the present invention.
Figure 4:
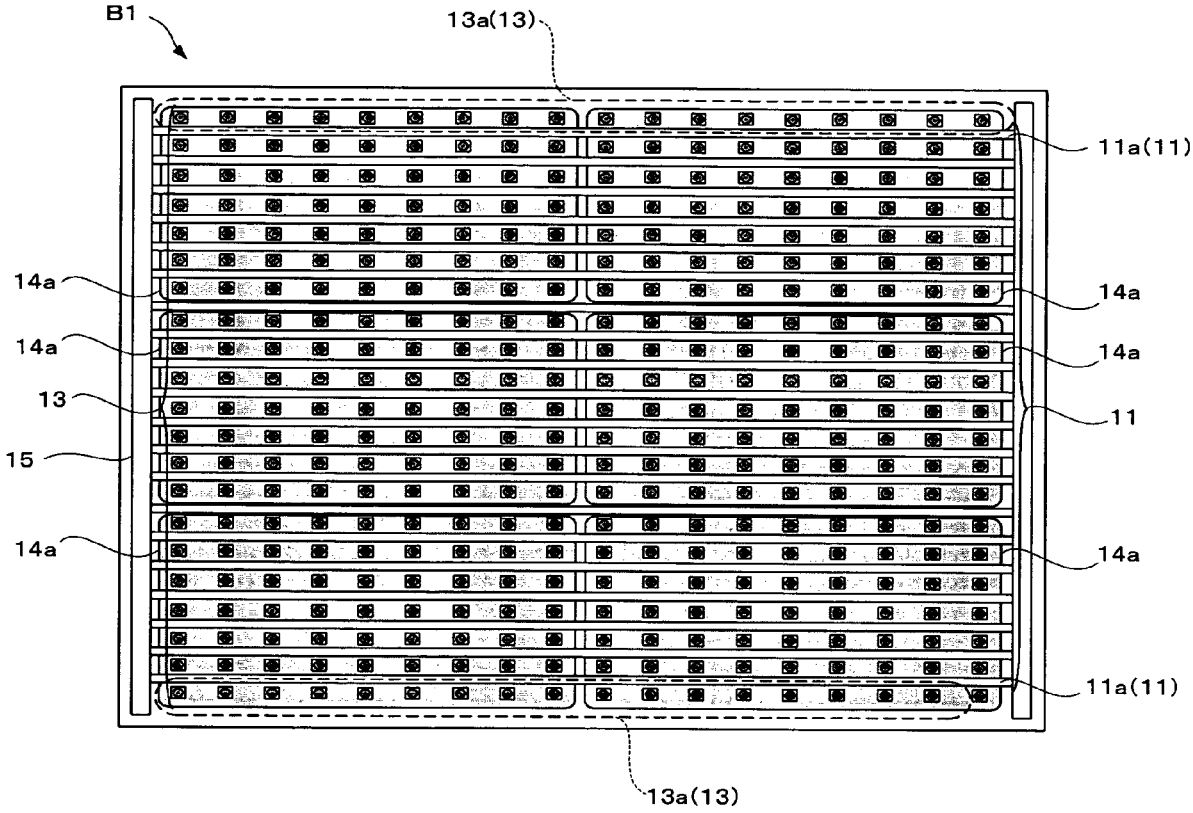
FIG. 4 shows an elevation view of a backlight unit according to Embodiment 1 of the present invention.

Next, as referring now to FIGS. 3 and 4, LCD device A1 according to Embodiment 1 of the present invention is described. Here, FIG. 3 shows a sectional side view of LCD device A1 according to Embodiment 1 of the present invention, and FIG. 4 shows an elevation view of Backlight unit B1 installed in LCD device A1. In addition, the structural elements of LCD device A1 and Backlight unit B1, which are same as those of LCD device A (see FIG. 1) and Backlight unit B (see FIG. 2), are given the same codes for abbreviation of illustration and description.

As shown in FIG. 3, Backlight unit B1 installed in LCD device A1 comprises an inverter circuit 121 (so called "two-in-one transformer") for controlling the drive of two Fluorescent tubes 11, instead of Inverter circuit 12 installed in Backlight unit B. Inverter circuit 121 is more preferably employed, as the sizes of Backlight unit B as well as the number of Fluorescent tubes 11 become larger.

In addition, a plurality of LED substrates 14*a* mounting LED 13 arrayed in 7 vertical columns and 9 horizontal rows, instead of a plurality of LED substrates 14, is mounted in Backlight unit B1.

In Backlight unit B1 constituted as above, the number of arrayed Fluorescent tubes 11 can be specified by the number of Inverter circuits 121 driving two Fluorescent tubes 11. In concrete terms, the number of arrayed Fluorescent tubes 11 is twice of the number of Inverter circuits 121.

Here, the structure of LED substrates 14*a* may become identical when Backlight unit B1 is constituted so as to satisfy the relation: X=(2M+1)/N, provided that M is the number of Inverter circuits 121, X is the number of LEDs 13 arrayed in a direction parallel to the array direction of Fluorescent tubes 11 in LED substrate 14*a*, and N is the number of LED substrates 14*a*. In concrete terms, as illustrated in the figure, X=7, M=10, and N=3, and so, the relation: X=(2M+1)/N is satisfied (X, M, and N are integer numbers).

Embodiment 2

Figure 5:
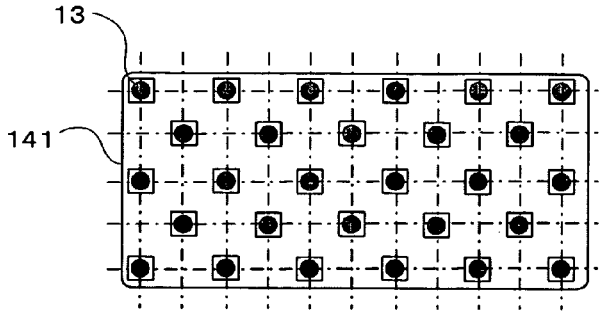
FIG. 5 shows a view for describing a deformation example of a LED substrate.
Figure 5:
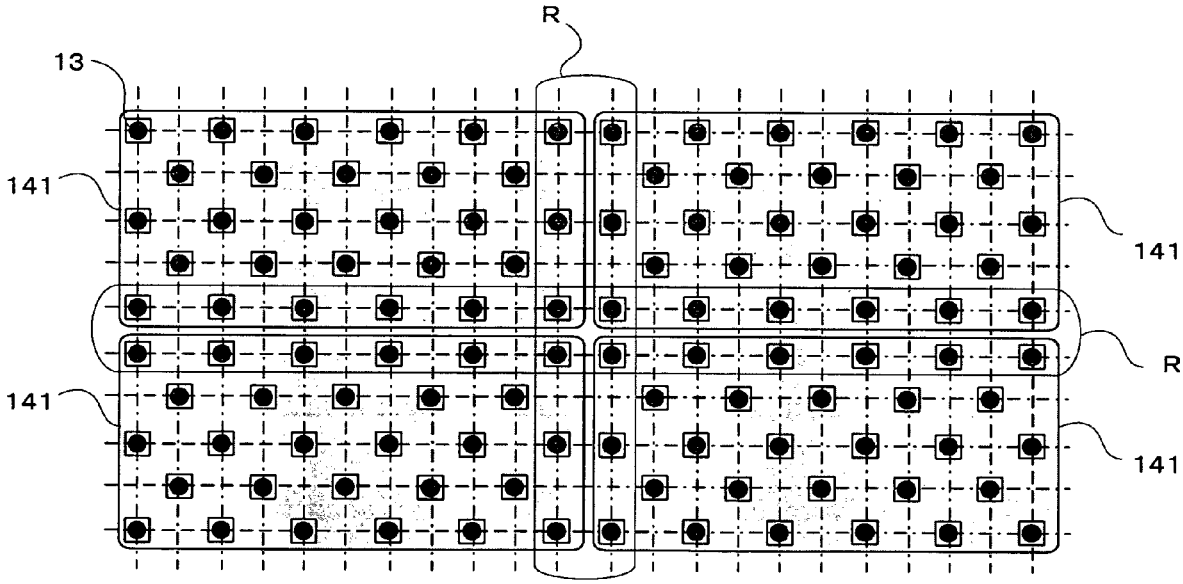
Figure 6:
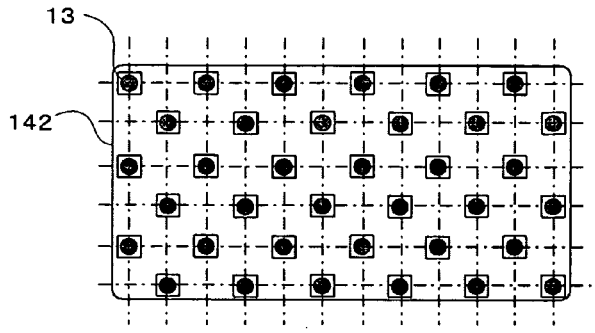
FIG. 6 shows a view for describing another deformation example of a LED substrate.
Figure 6:
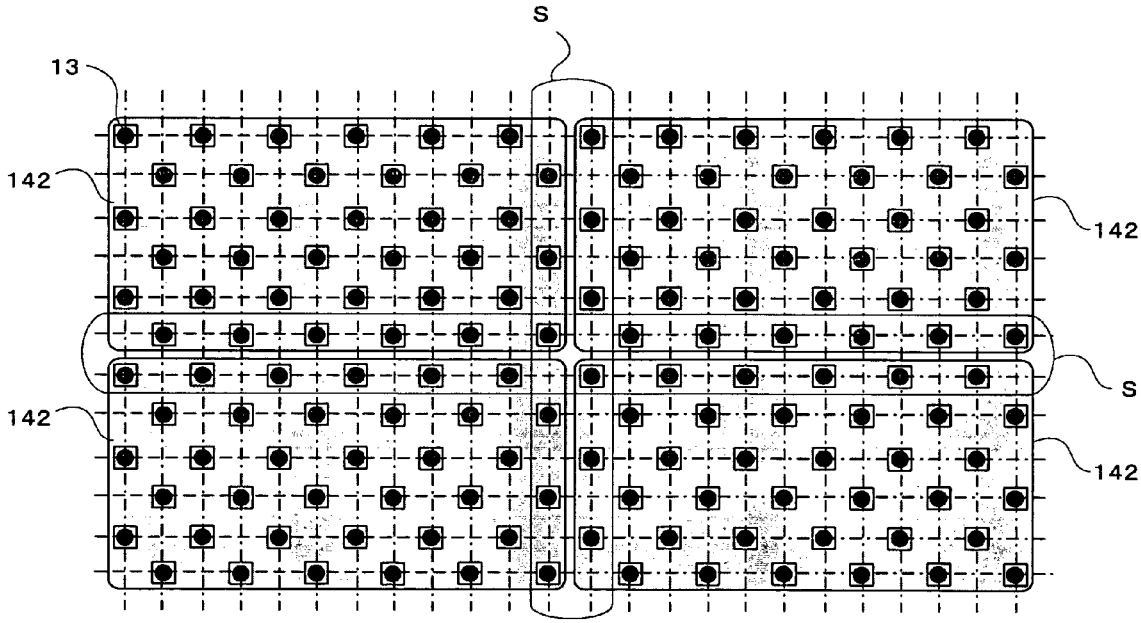

Next, as referring now to FIGS. 5 and 6, a deformation example of LED substrate 14 (14*a*) is described. Here, FIG. 5 shows a view for describing a deformation example of LED substrate 14 (14*a*), and FIG. 6 shows a view for describing another deformation example of LED substrate 14 (14*a*).

As illustrated in FIG. 5, in LED substrate 141 as a deformation example of LED substrate 14 (14*a*), LEDs 13 are arrayed in a zigzag manner. With such array of LEDs 13, the uniformity in emission colors in the entire Backlight unit B (B1) is enhanced.

Here, in LED substrate 141, LEDs 13 are arrayed in both ends of the both diagonal lines in said LED substrate 141. Therefore, as illustrated in FIG. 5(*b*), when a plurality of LED substrates 141 is combined, LEDs 13 are not arrayed in a zigzag manner within the combining site (the area R in the illustration). Also, when a LED substrate having an opposite array to LED substrate 141, that is, not having LEDs 13 in both ends of the both diagonal lines, is manufactured, the array of LEDs 13 in a zigzag manner within such combining site can be realized, though failing to achieve a great productivity.

Here, in LED substrate 142 as another deformation example of LED substrate 14 (14*a*) as illustrated in FIG. 6(*a*), LEDs 13 are arranged in both ends of one diagonal line, and arrayed in a zigzag manner so as not to be arranged in the both ends of the other diagonal line. In other words, in LED substrate 142, the number of arrayed LEDs 13 in each of horizontal directions is the same, while the number of arrayed LEDs 13 in each of vertical directions is the same.

Consequently, as illustrated in FIG. 6(*b*), when a plurality of LED substrates 142 is combined, the array of LEDs 13 in a zigzag manner can be realized within the combining site (the area S in the illustration). This enables improvement of the productivity for not requiring LED substrates of different shapes.

What is claimed is:

1. A backlight unit comprising a first compensating light source for compensating emission intensity of a prescribed wavelength light of a fluorescent tube, being arranged in between each of a plurality of said fluorescent tubes arrayed in a prescribed direction, wherein said backlight unit further comprises a second compensating light source for compensating emission intensity different from the emission intensity of the first compensating light source of a prescribed wavelength light of said fluorescent tube, being arranged in the outside of each of two fluorescent tubes arranged in the outermost of said plurality of fluorescent tubes, and the intensity of the second compensating light source is smaller than that of the first compensating light source.

2. A backlight unit, according to claim 1, wherein emission intensity of said second compensating light source is lower than emission intensity of said first compensating light source.

3. A backlight unit, according to claim 1, wherein emission intensity of said second compensating light source is nearly half of emission intensity of said first compensating light source.

4. A backlight unit, according to claim 1, wherein said first compensating light source and/or said second compensating light source have a plurality of light-emitting elements arrayed in the longitudinal direction of said fluorescent tube.

5. A backlight unit, according to claim 2, wherein said first compensating light source and/or said second compensating light source have a plurality of light-emitting elements arrayed in the longitudinal direction of said fluorescent tube.

6. A backlight unit, according to claim 3, wherein said first compensating light source and/or said second compensating light source have a plurality of light-emitting elements arrayed in the longitudinal direction of said fluorescent tube.

7. A backlight unit, according to claim 4, wherein a light source substrate in which said first and second compensating light sources are mounted is constituted to include a plurality of segmented substrates segmented in an array direction of said fluorescent tubes, and wherein a relation: X=(L+1)/N is satisfied, provided that L is the number of arrayed said fluorescent tubes, X is the number of light-emitting elements to be arrayed in a direction parallel to an array direction of said fluorescent tubes in said segmented substrate, and N is the number of said segmented substrates.

8. A backlight unit, according to claim 5, wherein a light source substrate in which said first and second compensating light sources are mounted is constituted to include a plurality of segmented substrates segmented in an array direction of said fluorescent tubes, and wherein a relation: X=(L+1)/N is satisfied, provided that L is the number of arrayed said fluorescent tubes, X is the number of light-emitting elements to be arrayed in a direction parallel to an array direction of said fluorescent tubes in said segmented substrate, and N is the number of said segmented substrates.

9. A backlight unit, according to claim 6, wherein a light source substrate in which said first and second compensating light sources are mounted is constituted to include a plurality of segmented substrates segmented in an array direction of said fluorescent tubes, and wherein a relation: X=(L+1)/N is satisfied, provided that L is the number of arrayed said fluorescent tubes, X is the number of light-emitting elements to be arrayed in a direction parallel to an array direction of said fluorescent tubes in said segmented substrate, and N is the number of said segmented substrates.

10. A backlight unit, according to claim 4, wherein one or a plurality of inverter circuits for driving two of said fluorescent tubes are further comprised, wherein a light source substrate in which said first and/or second compensating light sources are mounted is constituted to include a plurality of segmented substrates segmented in an array direction of said fluorescent tubes, and wherein a relation: X=(2M+1)/N is satisfied, provided that M is the number of said inverter circuits, X is the number of light-emitting elements to be arrayed in a direction parallel to an array direction of said fluorescent tubes in said segmented substrate, and N is the number of said segmented substrates.

11. A backlight unit, according to claim 5, wherein one or a plurality of inverter circuits for driving two of said fluorescent tubes are further comprised, wherein a light source substrate in which said first and/or second compensating light sources are mounted is constituted to include a plurality of segmented substrates segmented in an array direction of said fluorescent tubes, and wherein a relation: X=(2M+1)/N is satisfied, provided that M is the number of said inverter circuits, X is the number of light-emitting elements to be arrayed in a direction parallel to an array direction of said fluorescent tubes in said segmented substrate, and N is the number of said segmented substrates.

12. A backlight unit, according to claim 6, wherein one or a plurality of inverter circuits for driving two of said fluorescent tubes are further comprised, wherein a light source substrate in which said first and/or second compensating light sources are mounted is constituted to include a plurality of segmented substrates segmented in an array direction of said fluorescent tubes, and wherein a relation: X=(2M+1)/N is satisfied, provided that M is the number of said inverter circuits, X is the number of light-emitting elements to be arrayed in a direction parallel to an array direction of said fluorescent tubes in said segmented substrate, and N is the number of said segmented substrates.

13. A liquid crystal display device comprising a backlight unit according to claim 1.

14. A liquid crystal display device comprising a backlight unit according to claim 2.

15. A liquid crystal display device comprising a backlight unit according to claim 3.

16. A liquid crystal display device comprising a backlight unit according to claim 4.

17. A liquid crystal display device comprising a backlight unit according to claim 5.

18. A liquid crystal display device comprising a backlight unit according to claim 6.

19. A liquid crystal display device comprising a backlight unit according to claim 7.

20. A liquid crystal display device comprising a backlight unit according to claim 8.

21. A backlight unit comprising a first compensating light source for compensating emission intensity of a prescribed wavelength light of a fluorescent tube, being arranged in between each of a plurality of said fluorescent tubes arrayed in a prescribed direction, wherein said backlight unit further comprises a second compensating light source for compensating emission intensity different from the emission intensity of the first compensating light source of a prescribed wavelength light of said fluorescent tube, being arranged in the outside of each of two fluorescent tubes arranged in the outermost of said plurality of fluorescent tubes, and wherein a direction of the second compensating light source is the same as the direction of the first compensating light source.

* * * * *